United States Patent [19]

Blair

[11] Patent Number: 4,733,542

[45] Date of Patent: Mar. 29, 1988

[54] CABINET FOR AIR CONDITIONING SYSTEM

[75] Inventor: Robert R. Blair, Dallas, Tex.

[73] Assignee: Enviromaster International Corporation, Rome, N.Y.

[21] Appl. No.: 938,599

[22] Filed: Dec. 5, 1986

[51] Int. Cl.[4] ..... F25D 23/12

[52] U.S. Cl. ..... 62/263; 62/298; 312/236

[58] Field of Search ..... 62/263, 262, 298, 259.1, 62/285, 289; 98/114, 94.2; 312/242, 236, 245, 293, 257 R, 257 A, 263

[56] References Cited

U.S. PATENT DOCUMENTS

| | | | |
|---|---|---|---|
| 3,302,426 | 2/1967 | Laing | 62/263 X |
| 3,766,749 | 10/1973 | Livesay | 62/289 X |
| 3,917,757 | 11/1975 | Hoag | 312/263 X |
| 4,100,764 | 7/1978 | Murano | 62/289 |
| 4,416,327 | 11/1983 | Nakada et al. | 62/285 X |

*Primary Examiner*—Harry Tanner

*Attorney, Agent, or Firm*—Bruns and Wall

[57] ABSTRACT

A cabinet unit for housing component parts of an air conditioning system and in particular, to a cabinet formed by three molded sections that include a base section, a cover section and a back section that are interlocked in assembly to establish a high strength self-standing, rust proof enclosure. The back section contains a pair of internal vertical walls that coact with the cover section to form an air passage for connecting an inlet vent and an outlet vent and a separate equipment compartment adjacent to the air passage. A molded volute shaped wall closes the top of the air passage and forms a casing for housing a cylindrical fan. A guide means is removably supported in the front cover within the air passage adjacent the fan which serves to establish a stable laminar flow of air moving through the fan. By removing the front cover section free access is afforded to both the air passage and equipment compartment and further permits the guide vane to be changed so that different size fans can be accommodated within the rotor casing of the unit.

15 Claims, 7 Drawing Figures

CABINET FOR AIR CONDITIONING SYSTEM

BACKGROUND OF THE INVENTION

This invention relates to package terminal air conditioning units and in particular to a universal cabinet for housing component parts of an air conditioning system.

More specifically this invention relates to a package terminal air conditioning unit of the general type disclosed in U.S. Pat. No. 4,480,533. As noted in this patent these units, typically utilize free-standing low profile cabinets to house some or all of the component parts of an air conditioning system. The unit is designed to heat and/or cool a specific interior region of a building and is usually situated adjacent to an exterior wall of the building so that air can be exhausted through the wall to the outdoor atmosphere.

For the most part, most package terminal units are housed in extremely heavy and relatively bulky metal cabinets. The sheet metal panels are difficult to remove, as for example when periodic maintenance is to be performed, and the panels are easily dented and scratched when subjected to everyday use. More importantly however, the metal parts of the cabinet are continually exposed to condensate and liquid refrigerants which promote rapid oxidation of metals. As a consequence the metal cabinets become rusted and unsightly and eventually must be replaced.

The air handling characteristics of most metal cabinets have also been found to be relatively poor. The air passages are formed of sheet metal with little or no concern given to the aerodynamic properties of the system or the air handling properties of the fan. The fan is usually hung at some convenient place within the duct work. Movement of air through the unit is thus inefficient thereby adversely effecting the overall performance of the air conditioning system. These cabinets are also limited as to use in that they are dedicated in design to one particular air conditioning system and cannot be adapted for use with others.

SUMMARY OF THE INVENTION

It is therefore an object of the present invention to improve the packaging of air conditioning units.

A further object of the present invention is to provide a rust proof, self-standing universal cabinet capable of housing the component parts of different types of air conditioning systems for both heating and cooling a particular indoor region.

A still further object is to provide a self-standing air conditioner cabinet that is molded in section so that one of the sections can be easily removed from the assembly to provide complete access to all the air handling equipment, and air conditioning equipment housed within the cabinet.

Another object of the present invention is to provide a molded air conditioner cabinet having an air passage that is contoured to provide for efficient movement of air through the cabinet and which can accommodate different size and capacity fans.

Yet another object of the present invention is to provide an air conditioner cabinet that has a removable guide vane that acts in association with a volute shaped fan casing to efficiently direct air through a fan mounted inside the casing whereby the guide vane can be changed to accommodate different types of fans.

These and other objects of the present invention are attained by means of a universal air conditioner cabinet of all molded construction consisting of a base section, a rectangular shaped cover section and a back panel section that combines to form a self-standing unit for housing component parts of an air conditioning system. All sections are molded from a structural plastic to provide for a high strength, rust proof unit. The back panel section includes molded vertical walls that coact with the cover section to establish (1) a flow passage for connecting the air inlet vent and the outlet vent of the cabinet and (2) an equipment compartment adjacent to the air passage for housing component parts of an air conditioning system. The molded upper wall of the flow passage is contoured in the shape of a volute and forms a casing for housing an air moving fan. A guide vane is removably supported by the cover section inside the casing so that the guide vane and volute cooperate to efficiently move air through the passage. The size and shape of the guide vane can be changed to accommodate different size fan rotors whereby air conditioner systems of various designs and capacities can be accommodated within the cabinet without having to alter the cabinet's geometry. Once installed, both the air handling equipment and the air conditioning equipment can be easily accessed by simply removing the cover section.

BRIEF DESCRIPTION OF THE DRAWINGS

For a better understanding of these and other objects of the present invention reference is had to the following detailed description of the invention which is in association with the accompanying drawings, wherein.

DESCRIPTION OF THE INVENTION

Figure 1:
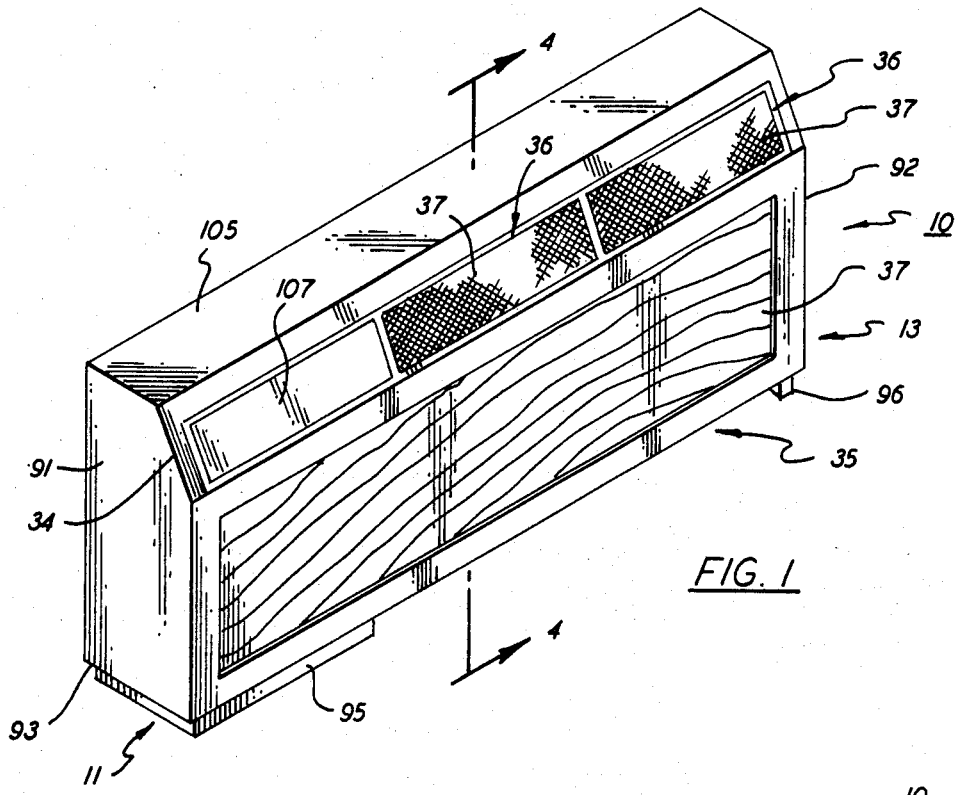
FIG. 1 is a perspective view of a molded universal cabinet embodying the teachings of the present invention, capable of housing the air handling equipment and other component parts of an air conditioning system.

Turning now to FIGS. 1–4, there is shown a universal air conditioner cabinet generally referenced 10 that is assembled by bringing together three interlocking sections to provide a self-standing unit as shown in FIG. 1. The term universal is herein used to indicate that the cabinet is adaptable for use in association with a wide range of air conditioning systems and is not specifically dedicated to house any one particular unit. The cabinet includes a rectangular shaped base section 11, a back panel section 12 and an open back, rectangular shaped cover section. The back panel section and the cover section 13 are arranged, as will be explained in greater detail below, to be suitably received in the base section.

All sections are molded from a structural styrene to provide for a high strength, rust proof assembly that is difficult to dent and/or scratch. As will become apparent from the disclosure below the cabinet can be adapted to accommodate different types of air conditioning systems without changing or altering its basic structure. The present cabinet thus possesses a flexibility unattainable by other cabinets now in use.

Figure 3:
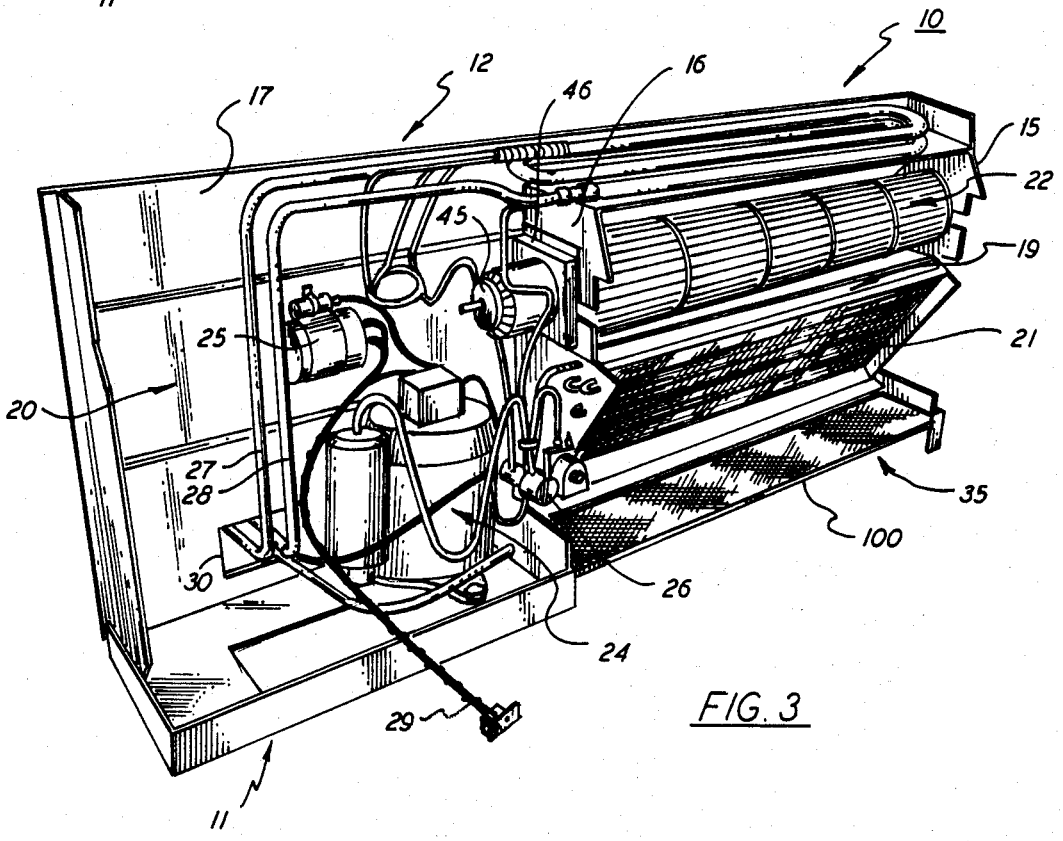
FIG. 3 is a perspective view of the cabinet shown in FIG. 1 with the front cover section removed to reveal the air handling equipment and the air conditioning equipment housed therein.

Although the cabinet can be used in association with any number of systems, it will be herein described with reference to a split system, sometimes referred to as a split-pack system, having an indoor unit and an outdoor unit (not shown). As best illustrated in FIG. 3, the cabinet 10 is divided into two adjacent zones by vertical walls 15 and 16 which are molded as an integral part of the rear wall 17 of the back panel section 12. These include an air passage, generally depicted at 19, and an adjacent equipment compartment generally depicted at 20 for housing the indoor components of the air conditioning system. A fan coil type heat exchanger 21 is obliquely positioned in the lower part of the air passage and is secured to the walls 15 and 16 by any suitable means. A cylindrical rotor 22, which forms part of a fan assembly 40 (FIG. 5) is rotatably mounted in the air passage immediately over the heat exchanger.

A compressor 23 is secured to the floor panel 25 of the base unit within the equipment compartment. An expansion valve 26 is also affixed to wall 16 within the compartment. The valve and the compressor are connected to the heat exchange by suitable refrigerant lines. Electrical components, as for example those shown at 25, are secured to the rear wall 17 and are connected to suitable control and drive systems related to the air conditioning system. Ample room is provided in the equipment compartment so that a wide range of component parts can be assembled therein in various configuration without crowding or limiting access thereto. A compartment being about 22" high, 16" long and 7" deep has been found adequate for this purpose. Although not shown, an outdoor unit containing a second heat exchanger and fan combination may be simply connected to the indoor unit by means of a pair of refrigerant lines 27 and 28 and an electrical line 29. The connecting lines are passed out of the equipment compartment through a small opening 30 formed in rear wall 17 of the back panel section. Alternatively, the connecting lines may similarly be passed out of the cabinet through a bottom opening 31 (FIG. 2) formed in the floor panel 25 of the base section. The connection between the indoor and outdoor units can be made through an extremely small opening formed in either the wall, window frame or under the flooring flush with the skirting.

As noted above, the back panel section 12 of the cabinet contains a pair of spaced apart walls 15 and 16 that are molded as an integral part of this section. The two vertical walls and the front cover section cooperate in assembly to enclose both the air passage 19 and the equipment compartment 20. The air passage serves to connect an air inlet vent 35 formed in the base section with a pair of air outlet vents 36—36 formed in the inclined partition 34 that makes up part of the front wall of the cover section. As seen in FIG. 1, removable screens 37—37 are placed over the outlet vents to enhance the aesthetic value of the cabinet and to prevent foreign objects from entering the air passage.

Figure 5:
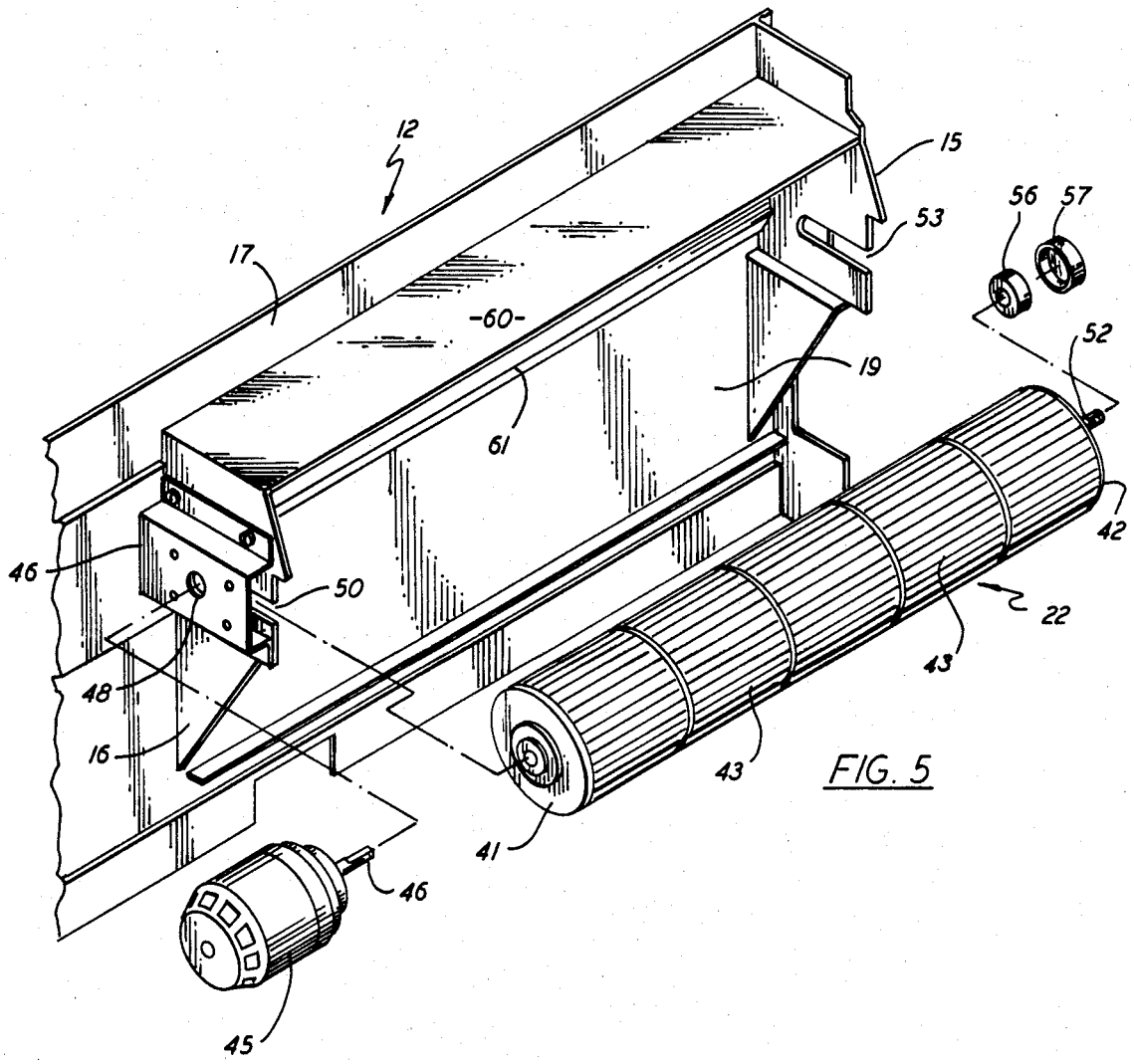
FIG. 5 is an exploded perspective view of the back panel section of the cabinet showing the air handling components.
Figure 6:
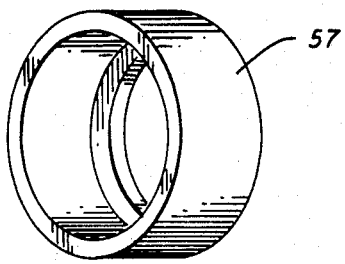
FIG. 6 is a perspective view of a bearing cap used to house the rotor bearing of the fan illustrated in FIG. 5.

The noted fan assembly, generally referenced 40 in FIG. 5, includes a high efficiency crossflow fan rotor 22 of cylindrical construction. Crossflow fan rotors of this type are manufactured by Ziehl-Abegg of Kumbelsau, West Germany. The rotor contains a pair of spaced end plates 41 and 42 between which are suspended a series of blades 43—43. Unlike more conventional blades, blades 43—43 are forwardly curved and equally spaced about the circumference of the structure between the end plates. The rotor is driven by an electrical motor 45 secured in a U-shaped mounting bracket 46. The bracket is affixed by screws or any other suitable means to the outside of vertical wall 16. The motor shaft 47 passes through hole 48 formed in the bracket and slotted hole 50 formed in wall 16. The shaft is keyed or otherwise joined to end plate 41 so that the rotor turns with the motor to conduct air through the air passage as indicated by the arrows in FIG. 4.

Figures 2, 7:
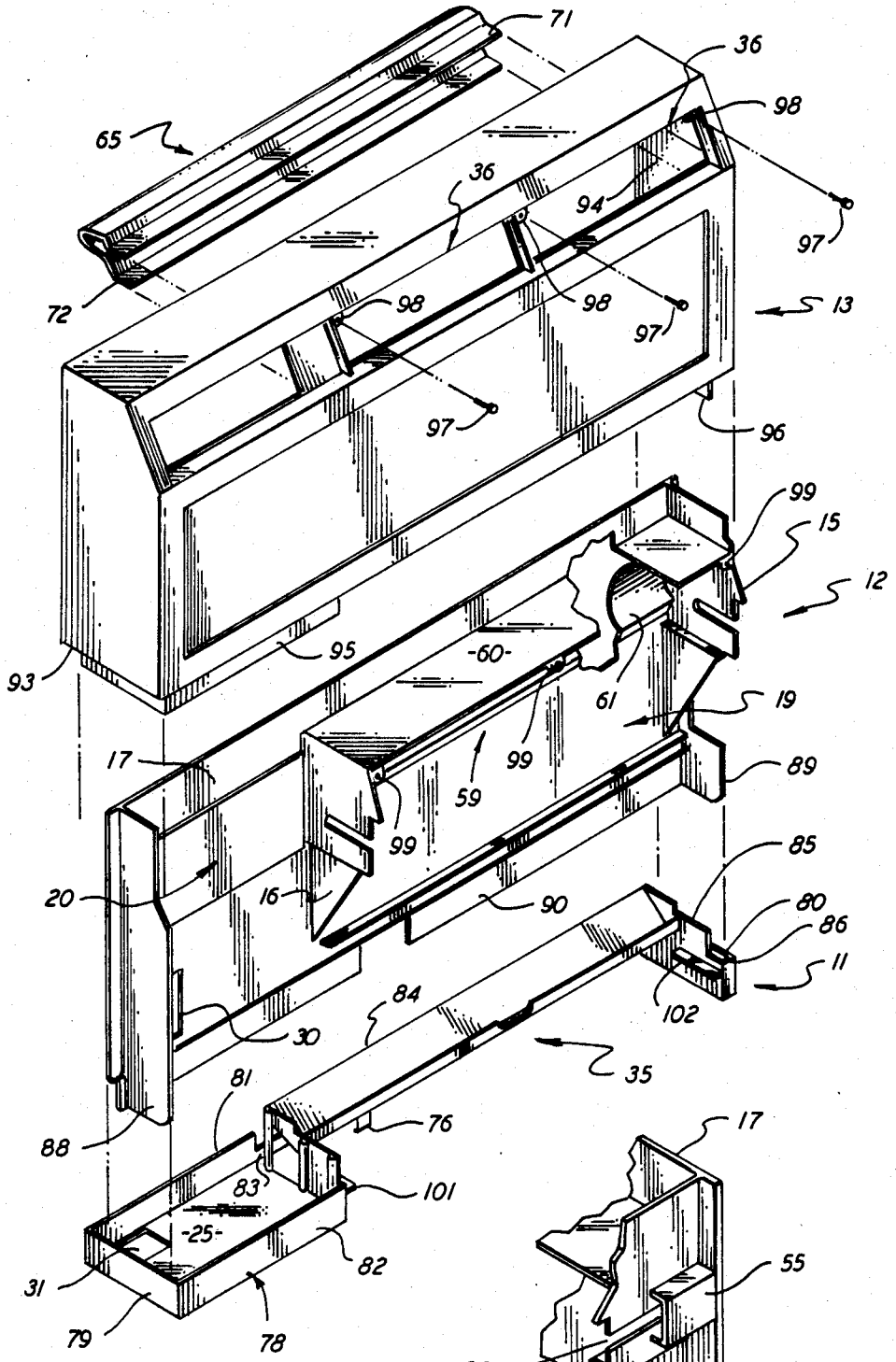
FIG. 2 is an exploded perspective view showing the main sections of the cabinet illustrated in FIG. 1.
FIG. 7 is a partial view in perspective of the back panel section further illustrating a bearing housing for containing the bearing cap as shown in FIG. 6.
Figure 4:
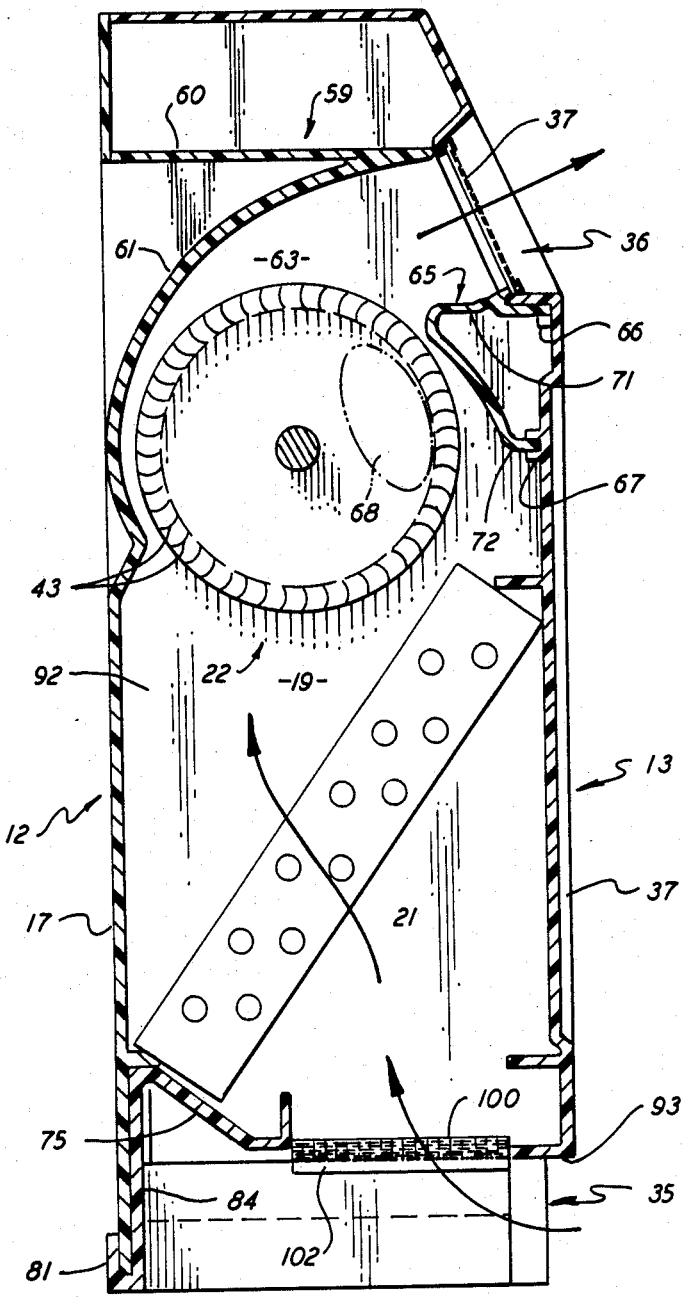
FIG. 4 is an enlarged side elevation in section taken along lines 4—4 in FIG. 1.

A stub shaft 52 is secured in the opposite end plate 42 of the rotor structure. The distal end of the stub shaft is adapted to pass through a slotted hole 53 formed in the wall 15 and is contained in assembly within an open ended bearing housing 55 (FIG. 7). A roller bearing 56 is press fitted onto the distal end of the shaft and covered by a close fitting end cap. The cap, in turn, is snuggly fitted within the housing to hold the fan rotor securely in place. With this simple mounting, the fan is able to turn at relatively high speeds without causing noisy or harmful vibrations.

The top of the air passage is closed by a top wall assembly 59 that includes a first horizontally disposed reinforcing panel 60 and an arcuate shaped volute 61 that forms a casing for housing the fan rotor. The top wall is molded integral with both the rear wall 17 and the two vertical walls 15 and 16 of the back panel section to provide a strong unitized structure. In assembly, the top wall and the vertical walls seat against the cover section to close the air passage. The volute is specially contoured to efficiently conduct air moving through the air passage quitely through the passage and out the outlet vents.

A V-shaped guide vane 65 formed of a resilient plastic is snap fitted into a pair of channels 66 and 67 (FIG. 4) formed in the back of front wall of the cover section 13. The guide vane coacts to create a zone of turbulence 68 inside the crossflow rotor structure. This circularly moving flow of turbulent air assumes a stationary position inside the rotor adjacent the guide vane which deflects or directs air moving through the structure into the discharge region 63 leading to the outlet vents 36. As a result of this arrangement a highly stabilized laminar flow of air is again moved quietly and efficiently through the fan structure thus avoiding many of the noise problems associated with sheet metal cabinets.

In assembly the opposed legs 71 and 72 of the guide vane are depressed and then slipped into the receiving channel. The deforming pressure on the legs is then released whereupon the legs move away from each other into tight biasing contact against the channel to secure the vane in assembly. As can be seen, the guide vane can be easily removed and replaced with a new vane. Accordingly, guide vanes of different sizes and shapes can be easily installed in the cabinet to accommodate various fan configurations with very little trouble and without adversely effecting the aerodynamics of the system.

A trough 75 is molded into the base section of the cabinet immediately below the air passage. The trough is designed to catch condensate that might run off the obliquely positioned heat exchanger 21. A drain 76

(FIG. 2) is mounted in the bottom of the trough which is connected to a drain line (not shown) for carrying condensate away from the cabinet.

The base section of the cabinet contains a raised rail assembly generally referenced 78 that surrounds the periphery of the floor panel 25. The rail assembly includes two side walls 79 and 80, a back wall 81 and a front wall 82. The back wall of the rail coacts with the vertical back wall 84 of the trough to form a channel 83 at the back of the base section. The side wall 85 of the trough further coacts with wall 80 of the rail assembly to provide a side channel 86 in this base section. The air inlet vent 35 passes through the front of the rail assembly immediately beneath the air passage 19.

The back panel section of the cabinet is equipped with an elongated side tab 88 and a second shorter opposing side tab 89. The lower portion of tab 88 is slidably received inside wall 79 of the rail assembly while tab 89 is similarly received in side channel 86. The two tabs are joined by an elongated apron formed along the bottom edge of rear wall 17. The apron is adapted to slide snugly into the channel 83 in the base section and thus support the back panel in an upright position in assembly.

With the back panel section mounted in the base section, the cover section is interlocked with the two assembled sections to close the cabinet. The cover section is also rectangular in form but slightly larger all around than the base section so that the front wall 37 and the two side walls, 91 and 92 of the cover section overhang the base slightly. A horizontal ledge 93 is inwardly disposed from the front wall and two side walls of the cover section which is seated upon the raised rail of the base. As shown in FIG. 2 a pair of vertically extended flanges depend from the ledge and include an L-shaped flange 95 and a straight flange 96. The L-shaped flange is slidably received between raised walls 78 and 79 of the base section with the tab 88 of the back section being situated inside the flange. The straight flange 96 is similarly received within the side channel 86 with the tab 89 of the back section again being positioned inside the flange.

The screws 97—97 are used to secure the cover section to the back panel section. As illustrated in FIG. 2, the screws are mounted in molded bases 98—98 located inside the air outlet vents and are threaded into holes 99—99 formed in the top wall assembly of the air passage. In assembly, the screws are covered by the screens used to cover the outlet vents. As can be seen, when the screws are tightened the walls of the air passage are drawn against the front wall of the cover section to provide tightly closed chamber connecting the air inlet vent and the two air outlet vents through which circulated indoor air can be efficiently conducted. The inlet vent is covered by a grill 100 which is suspended between a pair of brackets 101 and a 102 mounted upon the base section inside the inlet vent opening 35. (FIG. 2)

The horizontal top wall 105 of the cover section is joined to the inclined partition 34 of the front wall and provides a shelf upon which decorative items may be placed. An access door 107 is also hingedly mounted in the inclined partition of the front wall, behind which the control panel of the air conditioner may be conveniently mounted.

As should be evident from the disclosure above, all the equipment contained within the present cabinet is mounted upon either the base section or the back panel section. By removing the cover section, unobstructed access is provided to both the air handling equipment and the air conditioning equipment stored within the cabinet. It should be further noted that the cabinet's all molded construction not only provides for a rust-proof unit but also permits the air passage through the cabinet to be contoured to enhance the flow of air moving therethrough. By use of interchangeable guide vanes in the air passage, the cabinet can be easily adapted to accommodate almost any type of air conditioning system without loss of air handling efficiency. The all molded construction of the cabinet further provides for a high strength aesthetically pleasing unit that is both dent and scratch resistant.

While this invention has been described in detail with reference to particular embodiments, it should be understood that many modifications and variations would be apparent to those of skill in the art without departure from the scope and spirit of the invention, as defined in the appended claims.

What is claimed is:

1. A universal air conditioner enclosure for housing component parts of an air conditioning system, comprising a cabinet formed of interlocking molded plastic sections in which a base section, a front cover section, and a back panel section combine to form a self-standing enclosure, wherein the back panel section has spaced vertical walls molded integral with the back panel section and which coact with the cover section to define an air passage connecting an inlet vent and an outlet vent, and which also define an equipment cabinet adjacent the air passage, and a volute shaped upper wall in the air passage molded integral with the back panel section between the spaced vertical walls to form a rotor casing for housing a cylindrical fan rotor leading to the outlet vent, and wherein said front cover section includes a pair of horizontal retaining members on the inside thereof, and a V-shaped one-piece resilient guide vane removably supported by its ends in a biased condition in said retaining members so as to be removably supported upon the inside of the cover section within the air passage adjacent to the rotor casing, said V-shaped guide vane being interchangeable with similar members of different size so as to accommodate cylindrical fan rotors of different diameters, and all of the equipment contained in said enclosure being accessible for maintenance or repair simply by removal of only the front cover section.

2. The enclosure of claim 1 wherein the sections are molded from styrene.

3. The enclosure of claim 1 wherein said base section contains a floor panel and raised walls positioned about the periphery of the floor panel, and said cover section is an open backed rectangular structure that is seated upon and overhangs the raised walls of the base section.

4. The enclosure of claim 3 wherein the cover section and the back panel section each have downwardly disposed elements depending therefrom that are slidably received inside the raised walls of the base section.

5. The enclosure of claim 3 wherein the inlet vent is contained in the front wall of the base section and the outlet vent is contained in the front wall of the front cover section.

6. The enclosure of claim 4 that further includes fastening means for removably securing the cover section to the back panel section.

7. The enclosure of claim 6 wherein said fastening means are screws mounted inside the outlet vent and further including a removable screen means for covering the outlet vent and said screws.

8. The enclosure of claim 1 wherein the cover section has an access door that opens into the said equipment compartment.

9. The enclosure of claim 1 wherein said retaining members include two parallel channels in the inside of the front cover section, with the ends of the resilient V-shaped guide vane being supported in biased condition in said channels.

10. An enclosure for housing the component parts of an air conditioning system that includes a rectangular base section having a floor panel and raised walls surrounding the floor panel and an inlet vent contained in one of the raised walls, a rectangular cover section having opposed side walls, a front wall and a top wall, a lower horizontal ledge inwardly disposed from the bottom edges of the front and side walls that seats upon said one of the raised walls of the base section, and downwardly disposed locking elements depending from the ledge that are slidably received inside the raised walls of the base section, and an outlet vent in said front wall, a back panel slidably received inside the raised walls of the base section for closing the back of the cover section, said back panel having a pair of integrally formed spaced vertical interior walls that coact with the cover section to define an air passage for connecting the inlet and outlet vents and one of the spaced vertical interior walls also defining with the cover section an equipment compartment adjacent the air passage, and a volute-shaped upper wall for the air passage formed integrally in said back panel and that extends between the spaced vertical internal walls, each of said sections being integrally formed as a single piece of molded plastic, and interfitting each other in such a way that, by removing the cover section only, unobstructed access is gained to all of the equipment contained in the enclosure.

11. The enclosure of claim 10 that further includes a resilient, snap-in guide vane removably mounted inside the air passage opposite the volute shaped upper wall and connecting means on the inside front wall of the cover section for removably supporting the guide vane within the air passage.

12. The enclosure of claim 11 wherein said guide vane is a resilient V-shaped member and said connecting means includes a pair of spaced apart channels for receiving the legs of the member in a biased condition whereby the member is locked in said channels.

13. The enclosure of claim 10 wherein said base section further includes a trough beneath the air passage and drain means in said trough.

14. The enclosure of claim 10 that further includes fastening means located inside the outlet vent for removably connecting the back panel and cover sections, and screen means for covering the outlet vent and said fastening means.

15. The enclosure of claim 10 wherein said base section further includes bracket means for mounting a removable grill across the opening of the inlet vent.

* * * * *